US005123559A

United States Patent [19]

Qiu et al.

[11] Patent Number: 5,123,559

[45] Date of Patent: Jun. 23, 1992

[54] BUILT-UP INNER FLOATING CEILING FOR USE IN AN OIL STORAGE TANK

[76] Inventors: Zhang F. Qiu, Flat 304, Building 113, Yuanl, Shenzhen; Kong Z. Rui, Jianoghan Institute of Petroleum, Jianghan; Shi Y. Zhi, Beijing Petro-Chemical Institute, Beijing, all of China

[21] Appl. No.: 703,013

[22] Filed: May 20, 1991

[30] Foreign Application Priority Data

Oct. 26, 1984 [CN] China ..... 90222442.5

[51] Int. Cl.[5] ..... B65D 88/36

[52] U.S. Cl. ..... 220/218; 220/216

[58] Field of Search ..... 220/216, 217, 218, 219, 220/220, 221, 227

[56] References Cited

U.S. PATENT DOCUMENTS

| | | | |
|---|---|---|---|
| 1,748,231 | 2/1930 | Kimbell | 220/218 |
| 2,282,772 | 5/1942 | Wiggins | 220/216 |
| 2,606,684 | 8/1952 | Wiggins | 220/216 |
| 2,867,346 | 1/1959 | Champagnat . . | |
| 2,873,042 | 2/1959 | Fino . | |
| 2,919,047 | 12/1959 | Fino . | |
| 3,036,342 | 5/1962 | Fino | 220/218 X |
| 3,362,562 | 1/1963 | Marshall et al. . | |
| 3,910,452 | 10/1975 | Szasz | 220/226 |
| 3,942,674 | 3/1976 | Nelson | 220/221 |
| 4,018,356 | 4/1977 | Szasz et al. | 220/220 |
| 4,202,460 | 5/1980 | Imbeault | 220/218 |

FOREIGN PATENT DOCUMENTS

| | | |
|---|---|---|
| 0345625 | 1/1989 | European Pat. Off. . |
| 3141797 | 4/1983 | Fed. Rep. of Germany . |
| 1093630 | 5/1984 | U.S.S.R. . |

*Primary Examiner*—Stephen Marcus
*Assistant Examiner*—Nova Stucker
*Attorney, Agent, or Firm*—Anderson & Hirsch

[57] ABSTRACT

Discloses a kind of built-up inner floating ceiling for use in an oil storage tank, with a view to removing electrostatic effects. The ceiling comprised a skeleton and plastic buoys concentrically arranged thereon, under which there is provided a metallic net in contact with oil, said buoys being pressed from both sides by radial beams of said skeleton, and placed between peripheral beams at rear and front, with a cover plate at top and said metallic net at bottom, so that they are in contact with conductors at any side. Further, wires leading to the top of the oil tank are connected to said cover plates, and said buoys are filled with a conductive additive to remove accumulation of electrostatic charge. Such a floating ceiling can, therefore, be free from any electrostatic effects.

4 Claims, 1 Drawing Sheet

BUILT-UP INNER FLOATING CEILING FOR USE IN AN OIL STORAGE TANK

BACKGROUND OF THE INVENTION

This invention relates to a kind of built-up inner floating ceiling for use in an oil storage tank, particularly one suitable for use in a vertical cylindrical oil tank made of steel having a fixed ceiling.

Prior art shows that usually an inner floating ceiling is mounted in an oil tank, in order to reduce the evaporative loss of oil and prevent oil from contamination and degradation. A Chinese Patent CN 88 2 01602 disclosed a kind of built-up floating ceiling. The general structure of an inner floating ceiling is as follows. First, steel plates or aluminium plates are processed into H-shaped members, which are then bolted together to form a skeleton. Next, hard obturated foam plastic of polyaminoester is used to make buoys, which in turn are arranged concentrically on the skeleton to form an inner floating ceiling. The disadvantage of such a ceiling is that the problem of electrostatic prevention still remains unsolved. When such a floating ceiling is mounted in an oil tank, petroleum products tend to carry electrostatic charge of a certain symbol, since transfer of charge usually occurs during flow, filtration, feeding and sloshing of petroleum. That's why electrostatic effects cannot be prevented.

It is therefore the primary object of this invention to provide a built-in inner floating ceiling, which can remove electrostatic effects when used in an oil tank.

According to this invention, the afore-mentioned object can be attained with a built-in inner floating ceiling of which the skeleton is fitted with concentrically arranged plastic buoys containing a certain conductive additive, and a metallic net is mounted under said buoys. Said buoys are pressed from right and left, top and bottom, front and rear, by radial beams of the skeleton, cover plates and said metallic net, and peripheral beams of the skeleton, respectively. Said cover plates are further linked by wires to the top of the oil tank. In such a manner, all electrostatic charges are earthened and thus removed.

BEST MODE FOR CARRYING OUT THE INVENTION

Figure 1:
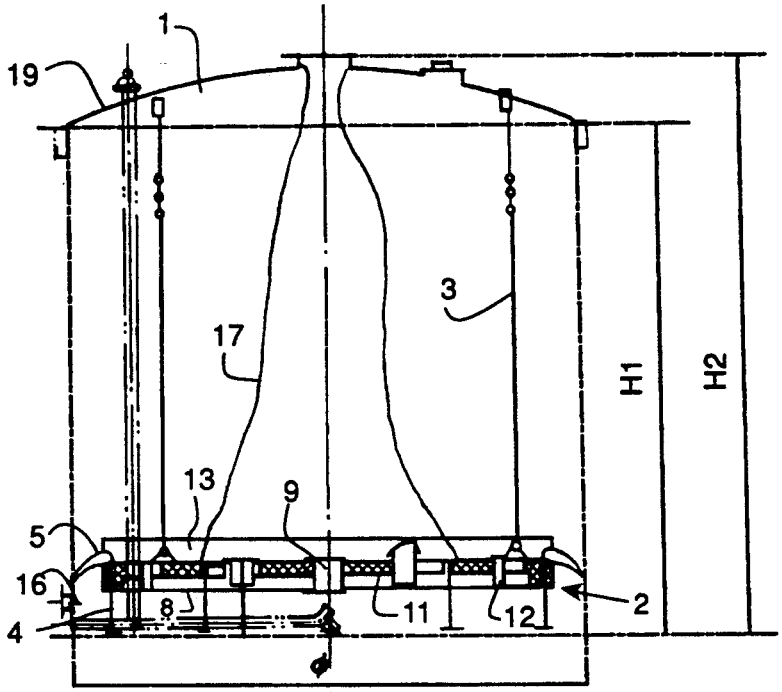
FIG. 1 is an illustration of a built-in inner floating ceiling mounted in a conventional oil tank.

Referring to FIG. 1, an inner floating ceiling 2 is mounted inside a conventional oil storage tank 1. Thirteen pieces of supporting legs 4 help holding said ceiling 2 in position. Besides, there are provided two pieces of anti-rotating steel wires 3 and a number of tongue-shaped seals 5 for sealing purpose. The inner floating ceiling 2 is further connected to the top of the oil tank 1 by wires 17.

Figure 2:
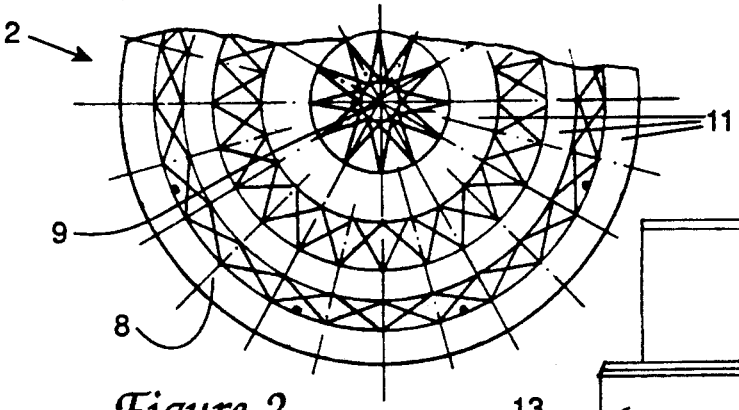
FIG. 2 illustrates the structure of an inner floating ceiling equipped with a metallic net and plastic buoys.

FIG. 2 shows that the inner floating ceiling 2 consists of eight pieces of girded girders 6, a number of cover plates 7, twenty four pieces of radial beams 8, a centre disc 9, thirty six pieces of peripheral beams 10, sixty pieces of plastic buoys 11, and thirty six pieces of liquid discharge pipes 12. Buoys 11, according to their mounting location, are divided into central buoys, middle buoys and exterior buoys.

Figure 3:
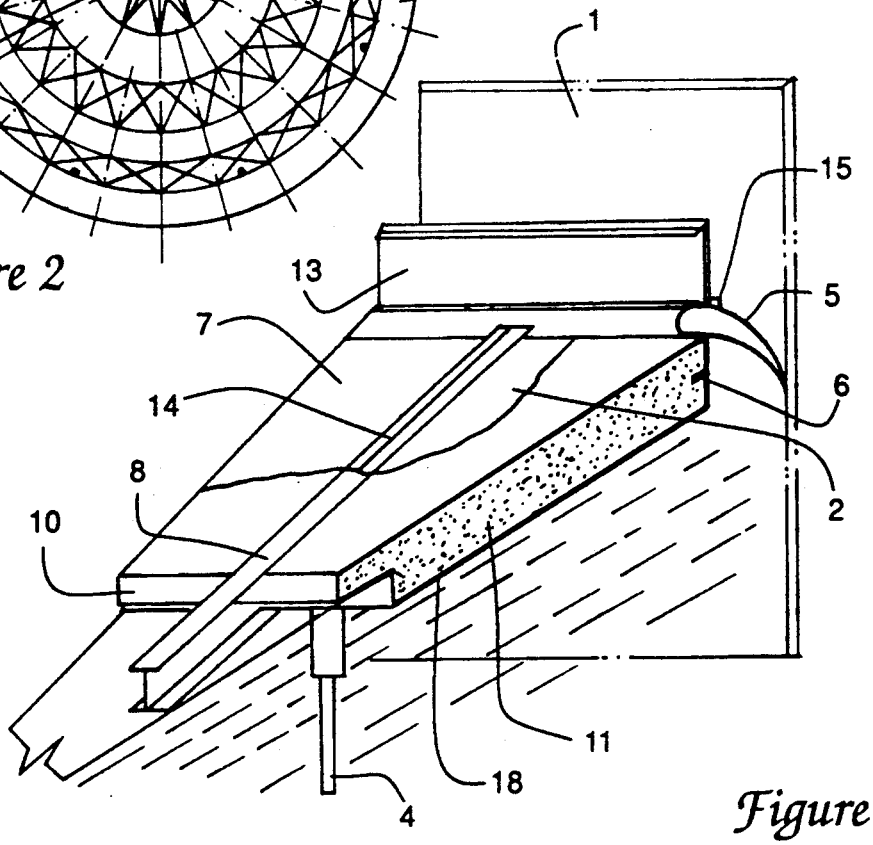
FIG. 3 is a fragmentary sectional view of an inner floating ceiling with plastic buoys and a metallic net.

FIG. 3, which is a fragmentary sectional view of an inner floating ceiling with plastic buoys 11 and metallic net 18, shows the assembling relations of the oil tank 1, legs 4, tongue-shaped seals 5, girders 6, cover plates 7, radial beams 8, peripheral beams 10, plastic buoys 11, fire-proof foam plates 13, pressing strips 14 and tongue-shaped seal fixing plates 15. Likewise, radial beams 8, peripheral beams 10 and legs 4 are also divided into the central one(s), the middle ones and the exterior ones.

For assembling, the girders 6 are first put into the oil tank 1 through an input hole 16, as indicated in FIG. 1. Then bolts are put into the respective connecting holes of the girders 6. Further, seal fixing plates 15 are adjusted so that the gap between the internal wall of the tank 1 and the outer periphery of the girders 6 is about 190 mm. A seal fixing plate is a long-shaped strip with holes in it. The distance from the centre of one of the holes to one short edge of the fixing plate is approx. 190 mm. So when the fixing plates 15 are slipped onto the bolts connecting the girders 6, through the afore-mentioned holes, and arranged to run radially, a gap of approx. 190 mm between the internal wall of the tank 1 and the outer periphery of the girders 6 can be ensured by pushing said girders 6 towards outside until said short ends of said fixing plates 15 touch said internal wall of said tank 1. After the above-mentioned adjustment, remove the fixing plates 15 and tighten the bolts to make the girders into an integral member. Next holders for legs 4 are fitted to the proper places of the girders 6 by means of screws; then put legs 4 into the holders, adjust the girders 6 to a proper mounting height of about 1.80 m., and fix legs 4 to said holders with screws.

To follow, the centre disk 9 is taken into the tank 1, and a centre leg 4 is mounted to a holder at the bottom of said disk 9. Likewise, adjustment is made to bring said centre disk 9 to a mounting height of about 1.80 m. Then, twenty four radial beams 8 are uniformly arranged with one end bolted to the girder 6 and the other end to the centre disk 9. Tighten all the bolts.

Thirdly, the central buoys 11 are wrapped in one or a multiple of layers of metallic net 18 and inlaid between two radial beams 8; two central peripheral beams 10 are then screwed tight onto the two radial beams 8, and the middle legs 4, screwed tight onto the middle peripheral beams 10. All sixty plastic buoys are mounted in the afore-mentioned manner.

Fourthly, the cover plates 7 are mounted in position and fixed with pressing strips 14. Then mount the liquid discharge pipes 12 and other related fittings into proper places on the inner floating ceiling 2, fit the anti-rotating steel wires 3 and connect properly the wires 17. To finish, mount the tongue-shaped seals 15 and fire-proof foam plates 13 onto the bolts connecting the girders 6, put on the fixing plates 15 (this time not radially, but peripherally) and tighten with nuts. The installation of an inner floating ceiling is thus completed.

The advantages of this invention follow:

1) Beneath the plastic buoys 11, there are provided one or a multiple of layers of metallic net 18. Since the floating ceiling according to this invention is of a radiate structure, the plastic buoys 11 are in contact with conductors at all six sides—between steel radial beams 8 at right and left, between steel peripheral beams 10 at front and rear, in contact with composite aluminium cover plates 7 at top and with metallic net 18 at bottom—so that the potential is substantially lowered and a safe structure free from electrostatics is thus realized.

2) A conductive additive is further added into the plastic buoys 11, so that accumulation of electrostatic charges can be further decreased.

3) Four wires 17 are further fitted to connect the cover plates 7 to the top 19 of the tank 1. That is, from the composite aluminium cover plates 7 four wires 17 are arranged at 90° intervals to link to the tank top, to provide a reliable electrostatic grounding.

The above four advantages of the inner floating ceiling according to this invention make possible a safe and reliable operation free from electrostatic effects.

What is claimed is:

1. A built-up inner floating ceiling for an oil storage tank, said oil storage tank having a tank top, said ceiling comprising:

a skeleton having radial and peripheral beams, said beams being conductive;

plastic buoys arranged in a circular array on said skeleton, said plastic buoys having buoy tops;

cover plates pressed on said buoy tops, each of said cover plates contacting and being bounded circumferentially by a pair radial beams, each of said cover plates contacting and being bounded radially by a pair of said peripheral beams;

a metallic net fitted beneath and contacting said buoys; and wires linking said cover plates to said tank top.

2. A built-up inner floating ceiling as recited in claim 1 wherein:

said beams are made of material selected from the group consisting of steel and aluminum; and said buoys are made of hard obturated foam plastic of polyaminoester.

3. A built-up inner floating ceiling as recited in claim 1 wherein said buoys include conductive material.

4. A built-up inner floating ceiling as recited in claim 1 wherein said wires are arranged at 90° circumferential intervals.

* * * * *